US007861381B2

(12) United States Patent
Többen

(10) Patent No.: US 7,861,381 B2
(45) Date of Patent: Jan. 4, 2011

(54) APPARATUS AT A SPINNING PREPARATION MACHINE IN WHICH A CLOTHED, RAPIDLY ROTATING ROLLER IS LOCATED OPPOSITE AT LEAST ONE COMPONENT AT A SPACING

(75) Inventor: Robert Többen, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 390 days.

(21) Appl. No.: 11/896,588

(22) Filed: Sep. 4, 2007

(65) Prior Publication Data

US 2008/0072401 A1 Mar. 27, 2008

(30) Foreign Application Priority Data

Sep. 21, 2006 (DE) ..... 10 2006 045 047

(51) Int. Cl.
*D01G 15/00* (2006.01)

(52) U.S. Cl. ..... 19/98; 19/65 A

(58) Field of Classification Search ..... 19/98; 57/264, 265; 700/139
See application file for complete search history.

(56) References Cited

U.S. PATENT DOCUMENTS

| | | | | |
|---|---|---|---|---|
| 6,009,700 | A * | 1/2000 | Wassenhoven et al. | 57/263 |
| 2004/0154135 | A1 * | 8/2004 | Leder | 19/98 |
| 2006/0128270 | A1 | 6/2006 | Hosel | |

FOREIGN PATENT DOCUMENTS

| | | | |
|---|---|---|---|
| DE | 38 11 681 | A1 | 10/1989 |
| DE | 102 13 349 | A1 | 10/2003 |
| DE | 103 23 168 | A1 | 12/2004 |
| EP | 06 27 508 | A1 | 5/1994 |
| EP | 1 057 907 | A1 | 12/2000 |
| GB | 2 272 468 | A | 5/1994 |

OTHER PUBLICATIONS

Uk Intellectual Property Office Search Report, dated Dec. 20, 2007, issued for corresponding Great Britain Application No. GB0718381.7.

German Patent Office Search Report, dated May 25, 2007, issued for corresponding German Application No. 10 2006 045 047.7 (and English translation of Section C).

* cited by examiner

*Primary Examiner*—Shaun R Hurley
(74) *Attorney, Agent, or Firm*—Venable LLP; Robert Kinberg; Leigh D. Thelen

(57) ABSTRACT

In an apparatus at a spinning preparation machine, especially a flat card, roller card or the like, a clothed, rapidly rotating roller is located opposite at least one component at a spacing. In order, by means that are simple and that save time, to make it possible to set a modified carding gap when components having different parameters (construction, properties) are replaced, the component has an electronic storage unit in which information relating to the nature of the component is arranged to be stored. A writing device for writing in the information and a reading device for reading out the information may be provided.

20 Claims, 3 Drawing Sheets

APPARATUS AT A SPINNING PREPARATION MACHINE IN WHICH A CLOTHED, RAPIDLY ROTATING ROLLER IS LOCATED OPPOSITE AT LEAST ONE COMPONENT AT A SPACING

CROSS REFERENCE TO RELATED APPLICATION

This application claims priority from German Patent Application No. 10 2006 045 047.7 dated 21 Sep. 2006, the entire disclosure of which is incorporated herein by reference.

BACKGROUND OF THE INVENTION

The invention relates to an apparatus at a spinning preparation machine, especially a flat card, roller card or the like, wherein a clothed, rapidly rotating roller is located opposite at least one component at a spacing, the spacing being influenced by the nature and/or number of components.

In calculating and setting carding gaps it is known to make use of a known arrangement of the machine in question and its components, with material-related and construction-related parameters of components and component groups also being used for calculations. If the configuration of such a machine is then changed in respect of the nature or number of the components in question, it may well be necessary to modify the calculation and setting of carding gaps accordingly. For correct carding gap calculations and adjustments, the parameters for different machine configurations have to be communicated to the control system of the machine. Manual input of those parameters by the machine operator is onerous and may be associated with errors.

In a flat card, the spacings between the cylinder clothing and the surfaces located opposite it (counterpart surfaces) are of major importance in terms of machine and fibre technology. The carding result, namely degree of cleaning, nep formation and fibre shortening, is substantially dependent on the carding gap, that is to say on the spacing between the cylinder clothing and the clothings of the revolving and fixed card flats. The guiding of air around the cylinder and the dissipation of heat are likewise dependent on the spacing between the cylinder clothing and clothed or non-clothed surfaces located opposite, for example take-off blades or casing elements. The spacings are subject to different influences which in some cases act in opposite directions. Wear on clothings located opposite one another results in widening of the carding gap, which is associated with an increase in the number of neps and with a decrease in fibre shortening. Increasing the speed of rotation of the cylinder, for example in order to increase the cleaning action, results in a widening-out of the cylinder and also of the clothing, on account of the centrifugal force, and therefore in a narrowing of the carding gap. Also, when processing large amounts of fibre and certain kinds of fibre, for example synthetic fibres, an increase in temperature causes the cylinder to expand to a greater extent than the rest of the machine surrounding it, so that the spacings are reduced for this reason also. The machine elements located radially opposite the cylinder, for example fixed carding segments and/or take-off blades, also expand.

The carding gap is influenced especially by the machine settings on the one hand and by the condition of the clothing on the other hand. In a flat card having a revolving card top, the most important carding gap is located in the main carding zone, that is to say between the cylinder and the revolving card top unit. At least one clothing, delimiting the work spacing of the entire carding zone, is in motion. In order to increase production by the flat card, it is desirable to select the operating speed of rotation—or operating velocity—of the mobile elements so that it is as high as fibre processing technology will allow. The work spacing is located in the radial direction (starting from the axis of rotation) of the cylinder.

In the case of carding, ever greater amounts of fibre material are being processed per unit time, which gives rise to higher speeds for the work elements and higher installed capacities. Increasing fibre material throughput (production) results in increased heat generation as a result of the mechanical work even when the working surface area remains constant. At the same time, however, the technological result of carding (sliver uniformity, degree of cleaning, nep reduction etc.) is being continually improved, which gives rise to an increase in active surfaces that are in carding engagement and to closer settings of those active surfaces relative to the cylinder (drum). The proportion of synthetic fibres processed (where more heat, compared to cotton, is generated by the contact with the active surfaces of the machine as a result of friction) is continually increasing. The work elements of high-performance flat cards are nowadays fully enclosed on all sides in order to meet the high safety standards, to prevent the emission of particles into the spinning room environment and to minimise the maintenance requirement of the machines. Gratings or even open material-guiding surfaces which allow air exchange belong to the past. As a result of the mentioned circumstances, the introduction of heat into the machine is markedly increased whereas the heat removed by convection is markedly reduced. The greater heating of high-performance flat cards that is caused thereby results in greater thermoelastic deformation which, because of the non-uniform distribution of the temperature field, affects the set spacings of the active surfaces. The spacings decrease between the cylinder and the card flats, doffers, fixed card flats and take-off positions provided with blades. In extreme cases, the gap set between the active surfaces can be completely consumed as a result of thermal expansion so that components in relative motion collide. The consequence, then, is major damage to the high-performance flat card concerned. All this means that, especially, the generation of heat in the working region of the flat card can result in disparate thermal expansion when the temperature differences between the components are too great.

In order to reduce or avoid the risk of collisions, the carding gap between clothings located opposite one another is, in practice, set relatively wide, that is to say a certain safety spacing is provided. However, a large carding gap results in undesirable nep formation in the carded sliver. Rather, an optimum value, especially a narrow value, is desirable, as a result of which the proportion of neps in the carded sliver is substantially reduced. Moving the elements located opposite one another towards one another results in a change in the spacing (carding gap) over the entire width of the machine.

The carding result is crucially influenced by the carding gap. This means that a carding gap which is, as far as possible, uniformly narrow over the working width leads to optimum results. From this it follows that, for the cylinder, the quality of its cylindrical shape is of crucial importance. In relation to the cylinder, a further problem lies in the fact that it is unevenly heated over the working width as a result of varying coverage by material and gap variations caused by manufacturing tolerances. In addition, the heat is dissipated to a greater extent in the edge regions than in the middle, leading to a build-up of heat there. This results in a temperature gradient from the middle of the working width to the edges. The disparate thermal expansion caused thereby gives rise to the cylinder becoming distended outwards in a convex shape (bulging) and accordingly leads to a deterioration of the carding gap. Consequently, the result of carding is adversely affected. Because the cylinder is the counterpart for all carding and take-off locations, this quality reduction occurs at all locations. The heating during operation gives rise, in the middle of the elements located opposite one another, for example the cylinder and carding elements, to a large amount of expansion, which decreases towards the edge regions. It is disadvantageous that, as a result thereof, the carding gap is uneven over the width of the flat card and, in the middle region, there is a risk of collision between the components.

In spinning preparation machines such as flat cards, fixed carding elements are much used. These fixed carding elements comprise a profiled carrier member and clothings attached thereto. The profiled carrier members can differ in terms of their construction and materials, the consequence of which is disparate dimensional stability and heat dissipation. From DE 38 11 681 A there is known a profiled carrier member for a fixed carding element, which can have different cross-sections. The profiled carrier member is made of an aluminium alloy. On replacement, the carding gap has to be matched to the new cross-sectional shape. This problem also occurs when a complete set (plurality) of card flats, each comprising a profiled carrier member and carding element, in the revolving card top unit of a flat card is replaced by a set having a different constructional arrangement and/or being made of a different material. Known profiled carrier member materials include cast iron, steel and plastics. In the aforementioned cases, determining and inputting the properties of the at least one new profiled carrier member for modification of the carding gap is labour-intensive.

SUMMARY OF THE INVENTION

It is an aim of the invention, accordingly, to provide an apparatus of the kind described at the beginning that avoids or mitigates the mentioned disadvantages and that especially makes it possible, by means that are simple and that save time, to set a modified carding gap when profiled carrier members having different parameters (e.g. construction, properties) are being replaced.

The invention provides an apparatus at a spinning preparation machine, having a clothed, rotating roller located opposite one or more components at a spacing, the spacing being influenced by the nature and/or number of said components, wherein at least one said component has an electronic storage unit in which information relating to the nature of the component is arranged to be stored.

As a result of the fact that the component has an electronic storage device, in which the parameters (properties) of the profiled carrier member are stored, they do not need to be separately determined. The stored data can especially be transferred to a reading device directly, preferably wirelessly. As a result, the parameters can be assigned to the, or each particular, component and the carding gap can be determined, or calculated, and set in accordance with the parameters (properties) of each component. The amount of work is substantially reduced. In addition, potential sources of error, especially resulting from manual inputting, are avoided. The apparatus according to the invention makes it possible, by means that are simple and that save time, to set a modified carding gap when profiled carrier members having different parameters (construction, properties) are being replaced. A particular advantage lies in the fact that, when a complete set of flats of a revolving card top is being replaced in a flat card having a revolving card top, significant differences (construction, properties) between the set of flats that is being replaced and the replacement set can be ascertained by means of markers and/or codes. The apparatus according to the invention can likewise be used advantageously in the case of stationary, fixed carding elements.

In certain preferred embodiments, there is provided a reading device for reading out the information from the storage unit and, optionally, a writing device for writing in the information. In certain preferred embodiments, transfer from the storage device to the reading device is performed wirelessly, for example, the data may be arranged to be transferred between the storage device and the reading device by radio or the transfer may be by light, for example, by infra-red. In certain especially preferred embodiments, the data transfer is by inductive means. It is preferred that the reading device, and if present the writing device, are connected to a superordinate flat card control device. Advantageously, information relating to the construction of the component is arranged to be read in. Advantageously, the information relating to the material of the component is arranged to be read in. In certain preferred arrangements, the information that is read out is used for setting the spacing (a) (carding gap).

Advantageously, the clothed component comprises a profiled carrier member and a carding element (clothing). In certain embodiments, the component is a fixed carding element. In other embodiments, the component is a flat of a revolving card top unit. There may be both at least one fixed carding element and at least one revolving card flat, each comprising a said storage unit. In some embodiments, the electronic storage unit has an integral power supply device. In some embodiments, the electronic storage unit can be provided with power by induction coupling, for example, with a reading device. Certain preferred embodiments may include a writing device which is capable of deleting and/or overwriting information present in the storage unit. Each writing device may be electrically connected to the machine control, for example, the flat card control device. Each reading device may be electronically connected to the machine control, for example, flat card control device. In certain preferred embodiments, a marker for the parameters of the component is arranged to be deletably written into the storage unit. The writing device is provided for writing, preferably deletably, to the storage unit a marker for the parameters of the component. Advantageously, a reading device is provided for reading the written marker indicating particular parameters. In certain embodiments, the storage unit is a miniature wireless chip. The reading device, where present, may be connected to, for example, integrated into, the machine control. The writing device, where present, may be connected to, for example, integrated into, the machine control. In practice, there will usually be a multiplicity of clothed components each defining with the roller a respective spacing, and two or more, for example, all, of the clothed components may each comprise a respective storage unit.

The invention also provides an apparatus at a spinning preparation machine, especially a flat card, roller card or the like, wherein a clothed, rapidly rotating roller is located opposite at least one clothed component at a spacing, the spacing being influenced by the nature and/or number of components, wherein the component has an electronic storage unit in which information relating to the nature of the component is arranged to be stored.

DETAILED DESCRIPTION OF CERTAIN PREFERRED EMBODIMENTS

Figure 1:
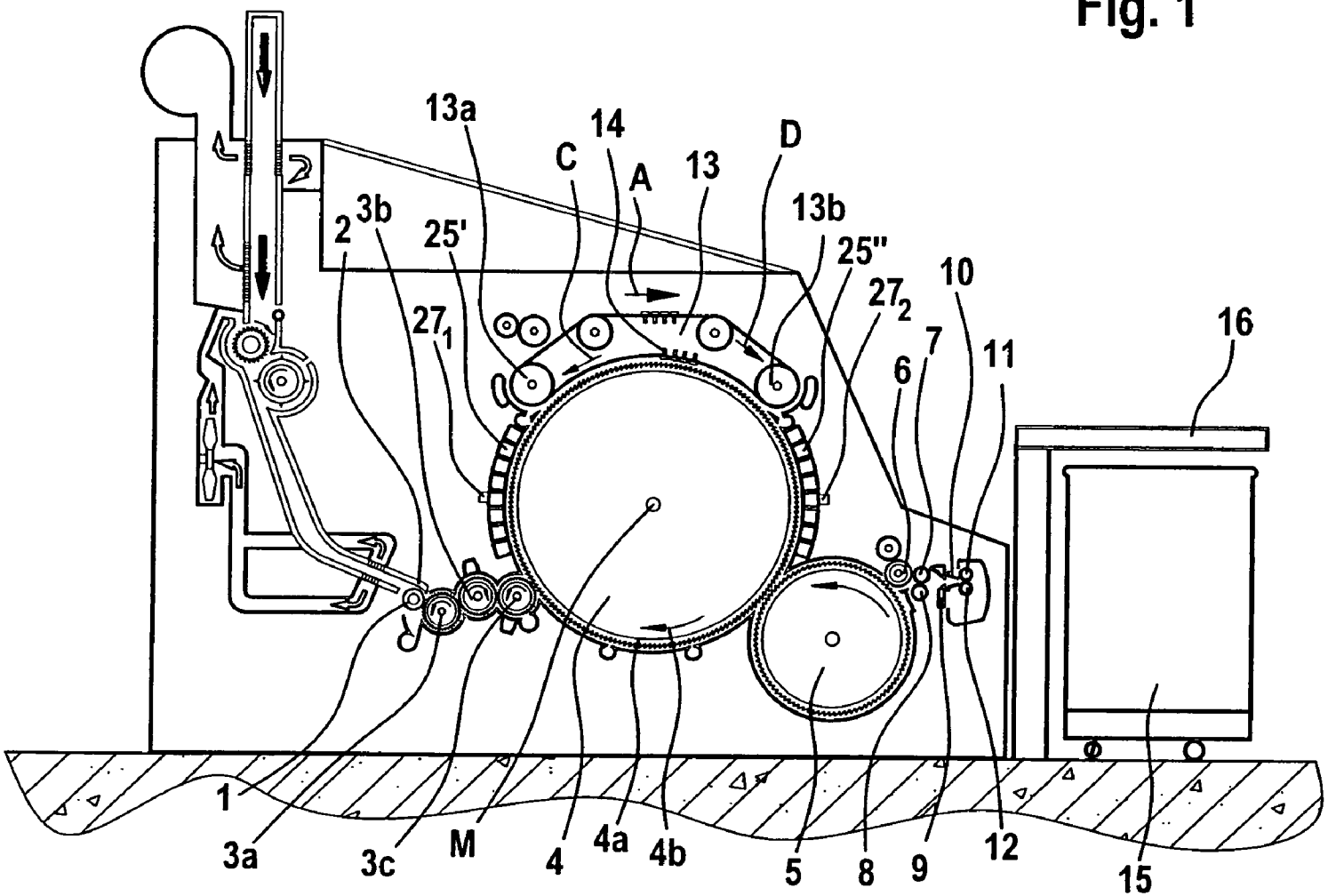
FIG. 1 is a diagrammatic side view of a flat card comprising one embodiment of the apparatus according to the invention.

With reference to FIG. 1, a flat card, for example, a TC 03 flat card made by Trützschler GmbH & Co. K.G. of Mönchengladbach, Germany, has a feed roller 1, feed table 2, lickers-in 3*a*, 3*b*, 3*c*, cylinder 4, doffer 5, stripper roller 6, nip rollers 7, 8, web-guiding element 9, web funnel 10, delivery rollers 11, 12, revolving card top 13 having card top guide rollers 13*a*, 13*b* and flats 14, can 15 and can coiler 16. The directions of rotation of the rollers are indicated by curved arrows. Reference letter M denotes the centre (axis) of the cylinder 4 and reference letter A denotes the working direction. Reference 4*a* denotes the clothing and reference 4*b* denotes the direction of rotation of the high-speed cylinder 4. Reference letter C denotes the direction in which the revolving card top 13 revolves at the carding location and reference letter D denotes the return transport direction of the flats 14. In the pre-carding region—between the licker-in 3*c* and the back card top guide roller 13*a*—there are arranged a plurality of fixed carding elements 25' (see FIG. 3), and in the post-carding region—between the front card top guide roller 13*b* and the doffer 5—there are arranged a plurality of fixed carding elements 25" (see FIG. 3). At each of the fixed carding elements 25' in the pre-carding region and at each of the fixed carding elements 25" in the post-carding region there is arranged a storage unit in the form of a storage chip $\mathbf{27}_1$ to $\mathbf{27}_2$, However, purely for the sake of simplicity, in each case it is only at one fixed carding element 25' or 25" that a storage chip $\mathbf{27}_1$ or $\mathbf{27}_2$, respectively, is shown.

Figure 2:
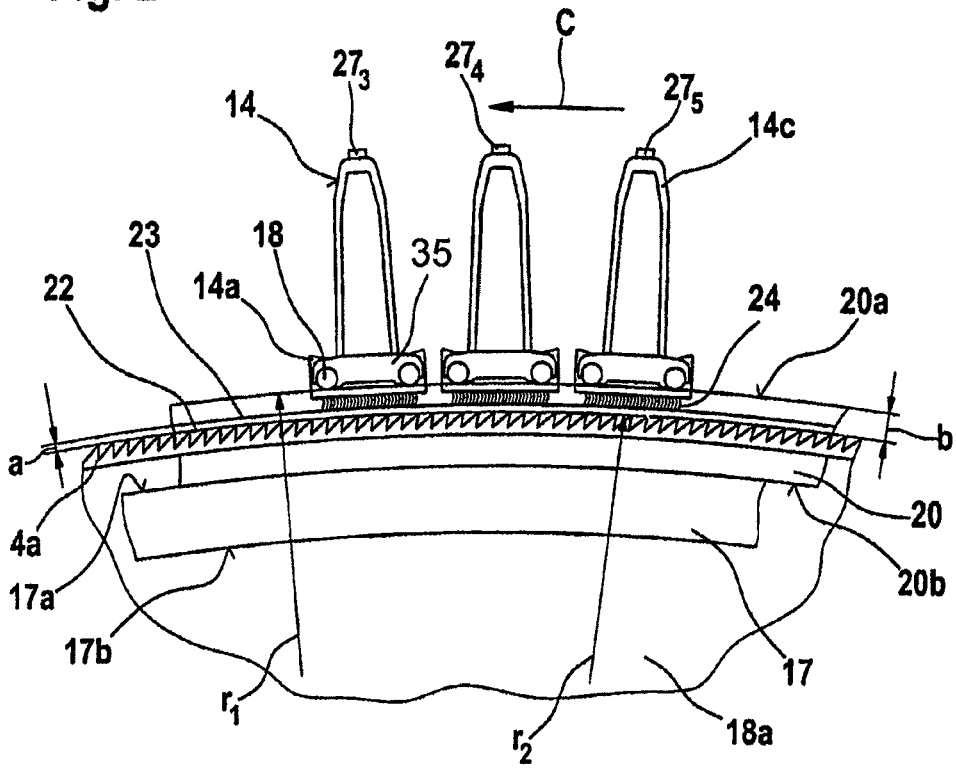
FIG. 2 shows a further embodiment of the invention in which flats of a revolving card top unit opposed to a part of a carding cylinder define a carding gap between the clothings of the revolving card top flats and the cylinder clothing, each of the card top flats shown having a storage chip.

In a further embodiment shown in FIG. 2, a flexible bend 17 having several adjustment screws is fixed laterally to the frame of the machine on each side, using screws (not shown). The flexible bend 17 has a convex outer surface 17*a* and an underside 17*b*. On top of the flexible bend 17 there is a slideway 20, for example made of low-friction plastics material, which has a convex outer surface 20*a* and a concave inner surface 20*b*. The concave inner surface 20*b* rests on top of the convex outer surface 17*a*. The card flats 14, which are extruded from aluminium, have a carrier member 14*c* in the form of a hollow profiled member, a card flat foot 14*a* and, at each of their two ends, a card flat head, in which there are mounted in an axial direction two steel pins 18, which slide on the convex outer surface 20*a* of the slideway 20 in the direction of arrow C. The card flat clothing 24 (small wire hooks) is mounted on the underside of the card flat foot 14*a*. Reference numeral 23 denotes the circle of tips of the card flat clothings 24. On the outside of the carrier member 14*c* of each of the card flats 14 there is arranged a storage chip $\mathbf{27}_3$, $\mathbf{27}_4$ and $\mathbf{27}_5$.

The cylinder 4 has on its circumference a cylinder clothing 4*a*, for example a sawtooth clothing. Reference numeral 22 denotes the circle of the tips of the cylinder clothing 4*a*. The spacing (carding gap) between the circle of tips 23 and the circle of tips 22 is denoted by reference letter a and is, for example, 2/1000". The carding spacing of the flat card, that is to say of the cylinder 4 having the cylinder clothing 4*a* and of the card flats 14 having the card flat clothings 24, is set in practice. In order to reduce or avoid the risk of collisions, the carding gap between clothings located opposite one another is in practice set to be slightly greater, that is to say a certain safety margin is provided. However, a large carding gap results in undesirable nep formation in the carded sliver. Rather, an optimum, especially a narrow, size is desirable, as a result of which the proportion of neps in the carded sliver is substantially reduced. The spacing between the convex outer surface 20*a* and the circle of tips 22 is denoted by reference letter b. The radius of the convex outer surface 20*a* is denoted by reference letter $r_1$ and the constant radius of the circle of tips 22 is denoted by reference letter $r_2$. The radius $r_2$ intersects the centre point M (see FIG. 1) of the cylinder 4. Reference numeral 14*c* denotes the back of the card flats. Reference numeral 35 denotes a clamping element, which engages around the card flat pins 18 and which is connected to the drive belt (not shown) for the card flats 14.

Figure 3:
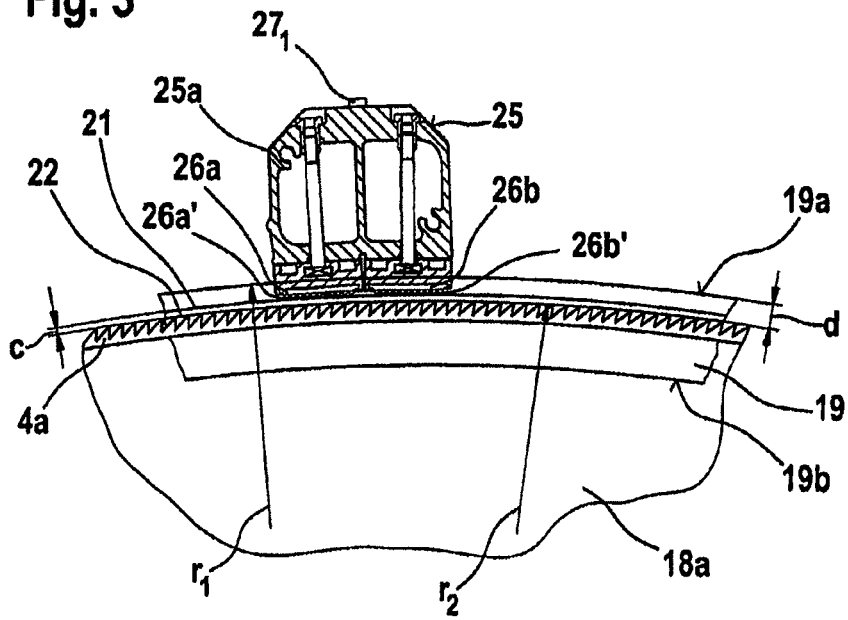
FIG. 3 shows a stationary carding segment with storage chips, and part of a side screen of a card, with a spacing between the carding segment clothing and the cylinder clothing.

In the embodiment of FIG. 3, an approximately semicircular, rigid side panel 18*a* is fixed laterally to the machine frame (not shown) on each side of the flat card, on the outside of which panel in the region of the periphery there is integrally cast in a concentric position a rigid arcuate supporting element 19, which has, as supporting surface, a convex outer surface 19*a* and an underside 19*b*. Stationary carding elements 25 have, at both their ends, mounting surfaces, which are mounted on the convex outer surface 19*a* of the mounting element. Fixed to the underneath surface of the carding element 25 are carding segments 26*a*, 26*b* having carding clothings 26*a*', 26*b*'. Reference numeral 21 denotes the circle of tips of the clothings 26*a*', 26*b*'. The cylinder 4 has, around its circumference, a cylinder clothing 4*a*, for example a sawtooth clothing. Reference numeral 22 denotes the circle of tips of the cylinder clothing 4*a*. The spacing between the circle of tips 21 and the circle of tips 22 is indicated by the reference letter c and is, for example, 0.20 mm. Reference letter d denotes the spacing between the convex outer surface 19*a* and the circle of tips 22. Reference $r_1$ denotes the radius of the convex outer surface 19*a* and reference $r_2$ denotes the radius of the circle of tips 22. The radii $r_1$ and $r_2$ intersect in the centre M (see FIG. 1) of the cylinder 4. The carding element 25 according to FIG. 3 consists of a carrier 25*a* and two carding segments 26*a*, 26*b*, which are arranged one after the other in the direction of rotation (arrow 4*b*) of the cylinder 4, the clothings (26*a*', 26*b*') of the carding segments 26*a*, 26*b* and the clothing 4*a* of the cylinder 4 lying opposite one another. The spacing c between the clothings 26*a*', 26*b*' of the carding segments 26*a*, 26*b* and the cylinder clothing 4*a* is of great importance to the carding process and to the result of carding. The storage chip $\mathbf{27}_1$ is fixed, for example by means of adhesion, screws or the like, on the outer wall surface of the carrier 25.

Figure 4:
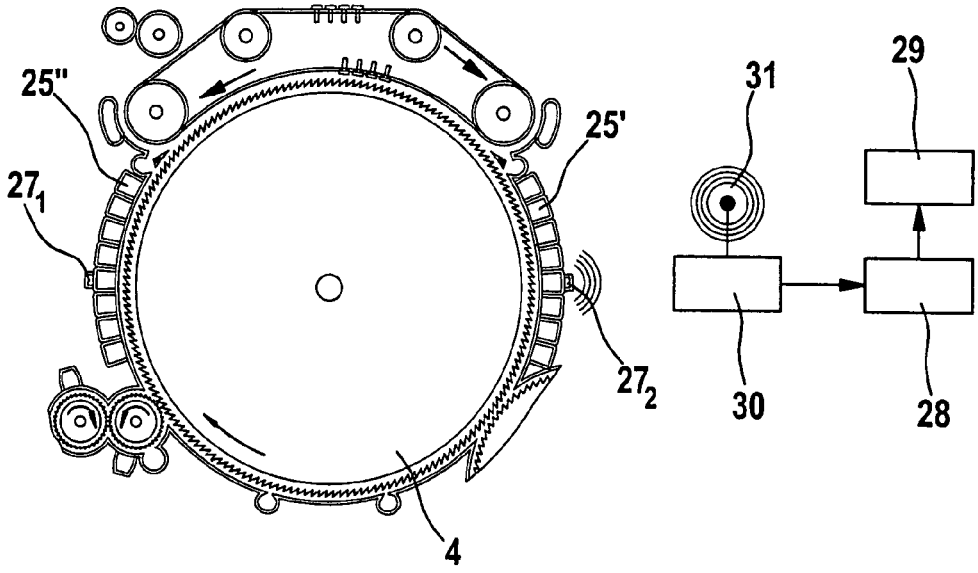
FIG. 4 shows part of the side view of the flat card according to FIG. 1 and a diagrammatic block circuit diagram with a writing device, a reading device and an electrical control and regulation device (machine control) and also, in diagrammatic form, the data transfer by radio between the storage device and the reading device.

In a further embodiment shown in FIG. 4, there is provided an electrical control and regulation device 28 (machine control) for the flat card, to which a writing device 29 for writing the information on the storage chips $\mathbf{27}_1$ and $\mathbf{27}_2$ and a reading device 30 for reading the information therefrom are connected. In the example shown, the data is wirelessly transferred between the storage element $\mathbf{27}_2$ and the reading device 30 by radio. The storage device $\mathbf{27}_2$ is equipped with a transmitter device (not shown) having an integral antenna and the reading device 30 is equipped with a receiver device comprising an antenna 31. Whereas storage devices are shown only on stationary carding elements 25 in FIG. 4, one or more revolving card flats of the revolving card top may optionally also be provided with electronic storage units which may be read by further reading and/or writing devices attached to the machine control 28.

A miniature wireless chip can be used as the storage devices $\mathbf{27}_1$ to $\mathbf{27}_5$ in any of the embodiments shown. The chip may be provided with an integral antenna. Such a chip can store, for example, 4 MB or more. Access to the data on the storage chips $\mathbf{27}_1$ to $\mathbf{27}_5$ is accomplished, in the embodiment of FIG. 4, by means of a specific reading (30) and writing (29) device, which is positioned in the vicinity of the chip. The data stored on the chips $\mathbf{27}_1$ to $\mathbf{27}_5$ are displayed on this device, and new data can also be stored from this device. The chips $\mathbf{27}_1$ to $\mathbf{27}_5$ can be adhesively mounted on the surface of the component 14, 25, embedded in the component 14, 25 or constructed as self-adhesive and releasable small dots. The chips $\mathbf{27}_1$ to $\mathbf{27}_5$, which can, for example, be as small as 2 square. millimeters, is a storage device, for example based on a CMOS, an economical power circuit design. The chips $\mathbf{27}_1$ to $\mathbf{27}_5$ are is expediently independent and is not dependent on external batteries or power supplies. It can be provided with power by the induction coupling of the reading device 30, in the process of which the energy of one circuit component is transferred to the other component by way of a common magnetic field. As a result of its small size, its storage capacity and rapid speed of access, the preferred chips $\mathbf{27}_1$ to $\mathbf{27}_5$ allow direct access to digital data.

The reading device 30 and writing device 29 of FIG. 4 may likewise be used with any of the embodiments of FIGS. 1 to 3, or any other suitable reading and/or writing device may be used.

A basic idea of the apparatus according to the invention lies in the fact that, for correct calculation of, for example, carding gaps, further variable parameters are required which cannot be measured on-line. These variable parameters are, for example, material-dependent deformation of components under the influence of temperature differences. Likewise, different constructional properties can also alter the deformation of components under the influence of temperature differences. These parameters have to be communicated to the control system without being measured on-line. Data of this kind is ascertained, as it were, at the premises of the machine manufacturer and may well be altered as a result of constructional measures. Once known, the parameters can be stored on the storage chips $\mathbf{27}_1$ to $\mathbf{27}_5$ associated with the component in question.

As a material-related parameter there is used, for example, the coefficient of linear expansion [1/K], in the course of calculations for calculating the carding gap. As a construction-related parameter there is designated, for example, a component-dependent factor which is multiplied in the description by a measured temperature difference. The objective in this case is to calculate a carding gap modification. A carding gap is not pre-specified. The calculated carding gap modifications can, however, be applied at the components in question by suitable actuation means.

Although the foregoing invention has been described in detail by way of illustration and example for purposes of understanding, it will be obvious that changes and modifications may be practised within the scope of the appended claims.

What is claimed is:

1. An apparatus at a spinning preparation machine, comprising:

a rotating roller including a clothing;

a component located opposite the clothing of the rotating roller, wherein a spacing separates the clothing of the rotating roller and the component;

an electronic storage unit coupled to the component, wherein the electronic storage unit stores parameters of the component; and an actuation device that adjusts the spacing based on the parameters stored in the electronic storage unit.

2. An apparatus according to claim 1, further comprising a reading device for reading out the parameters.

3. An apparatus according to claim 1, further comprising a writing device for writing in the parameters.

4. An apparatus according to claim 1, wherein the electronic storage unit is adapted to transfer the parameters to and/or from the electronic storage unit wirelessly.

5. An apparatus according to claim 4, wherein the electronic storage unit is adapted to transfer the parameters to and/or from the electronic storage unit by radio, by light, or by inductive means.

6. An apparatus according to claim 1, further comprising:

a superordinate control device; and a writing device and/or a reading device adapted to transfer the parameters to/from the electronic storage unit to the superordinate control device.

7. An apparatus according to claim 1, wherein the electronic storage unit stores a parameter relating to the construction of the component.

8. An apparatus according to claim 1, wherein the electronic storage unit stores a parameter relating to the material of which the component is constructed.

9. An apparatus according to claim 1, further comprising a writing device adapted to delete and/or overwrite the parameters present in the electronic storage unit.

10. An apparatus according to claim 1, further comprising a control device and a plurality of writing devices and/or a plurality of reading devices and/or a plurality of reading devices, wherein each writing device and/or reading device is electrically connected to the control device.

11. An apparatus according to claim 1, in which a marker for the parameters of the component is arranged to be deletably written into the electronic storage unit.

12. An apparatus according to claim 1, in which the component comprises a profiled carrier member and a card clothing.

13. An apparatus according to claim 1, in which the component is a fixed carding element.

14. An apparatus according to claim 1, in which the component is a flat of a revolving card top unit.

15. An apparatus according to claim 1, in which the electronic storage unit has an integral power supply device.

16. An apparatus according to claim 1, in which the electronic storage unit is a miniature wireless chip.

17. An apparatus according to claim 1, in which there is a multiplicity of components opposed to the roller and two or more of the components each have an electronic storage unit.

18. A method of controlling a spacing between a clothed, rapidly rotating roller and an opposed clothed component of a spinning preparation machine, comprising reading parameters of the opposed clothed component from an electronic storage unit provided on said opposed clothed component and adjusting the position of the opposed clothed component in dependence on the parameters of the opposed clothed component read from the electronic storage unit.

19. An apparatus according to claim 1, wherein the parameters comprise variable parameters of the component.

20. The method of claim 18, wherein the parameters comprise variable parameters of the component.

* * * * *